US007137938B2

(12) United States Patent
Gottlieb

(10) Patent No.: US 7,137,938 B2
(45) Date of Patent: Nov. 21, 2006

(54) EXERCISE DEVICE AND METHOD OF USING THE SAME

(76) Inventor: Marc S. Gottlieb, 8709 Walkelin Ct., Raleigh, NC (US) 27615

( * ) Notice: Subject to any disclaimer, the term of this patent is extended or adjusted under 35 U.S.C. 154(b) by 167 days.

(21) Appl. No.: 10/192,341

(22) Filed: Jul. 10, 2002

(65) Prior Publication Data

US 2004/0009859 A1 Jan. 15, 2004

(51) Int. Cl.
*A63B 22/14* (2006.01)
*A63B 22/16* (2006.01)

(52) U.S. Cl. ..... 482/146; 482/34; 482/147; 482/79; 482/80

(58) Field of Classification Search ..... 482/146–147, 482/77–80, 34; 446/325–6; D21/671, 662
See application file for complete search history.

(56) References Cited

U.S. PATENT DOCUMENTS

| | | | |
|---|---|---|---|
| 246,458 | A | 8/1881 | Chandler |
| 259,752 | A | 6/1882 | Fisher, Jr. |
| 478,166 | A | 7/1892 | Madsen |
| 516,368 | A | 3/1894 | Davis |
| 793,101 | A | 6/1905 | Schmidt |
| 808,706 | A | 1/1906 | Villedrouin |
| 980,025 | A | 12/1910 | Titus |
| 1,254,694 | A | 1/1918 | Humphries |
| 1,333,005 | A | 3/1920 | Warner |
| 1,345,322 | A | 6/1920 | Foans |
| 1,509,793 | A | 9/1924 | Thompson |
| 1,531,670 | A | 3/1925 | Levy |
| 1,565,484 | A | 12/1925 | McWhirter |
| 1,866,906 | A | 7/1932 | Rager |
| 2,002,561 | A | 5/1935 | Wike |
| 2,206,902 | A | 7/1940 | Kost |
| 2,256,001 | A | 9/1941 | Titus |
| 2,351,293 | A | 6/1944 | Saunders |
| 2,466,116 | A | 4/1949 | Margong |
| 2,533,368 | A | 12/1950 | Hansen et al. |
| 2,714,007 | A | 7/1955 | Jordan |
| D178,996 | S | 10/1956 | Gordon |
| 2,785,896 | A | 3/1957 | Ellis |
| 2,803,461 | A | 8/1957 | Coplin |
| 2,827,894 | A | 3/1958 | Meyers |

(Continued)

OTHER PUBLICATIONS

Esa-Pekka Takala, Iikka Korhonen, Eira Viikari-Juntura; Postural sway and stepping response among working population: reproducibility, long-term and associations with symptoms of the low back; Clin. Biomech. vol. 12, No. 7/8, 429-437, 1998; 9 pgs.

(Continued)

*Primary Examiner*—Lori Amerson
(74) *Attorney, Agent, or Firm*—Coats & Bennett, P.L.L.C.

(57) ABSTRACT

An exercise device for conditioning and rehabilitation of the nerves, muscles, bones, and joints of the body by facilitating or limiting range of motion and biomechanical forces around the horizontal and vertical axes. The device includes a fulcrum connected to a first side of a base. The fulcrum extends outward from the base and provides a point about which the device pivots. Fulcrum includes a recess having a removable attachment. When the attachment is connected, the fulcrum has a rounded shape. A user positioned on the base can pivot about the fulcrum in substantially 360° of motion to fully work their body. When the attachment is removed, rails forming the recess limit the range of motion to a user to between substantially a first orientation and a second orientation. The range of motion with the attachment removed being less than the range of motion with the connected attachment.

20 Claims, 5 Drawing Sheets

U.S. PATENT DOCUMENTS

| | | | | |
|---|---|---|---|---|
| 2,862,710 | A | 12/1958 | Lewis | |
| 2,941,801 | A * | 6/1960 | Pedersen | 482/146 |
| 2,950,120 | A | 8/1960 | Stewart | |
| 3,020,046 | A | 2/1962 | Hotas | |
| 3,021,137 | A | 2/1962 | Palmer et al. | |
| 3,024,021 | A | 3/1962 | Coplin et al. | |
| 3,063,714 | A | 11/1962 | Krauss | |
| 3,084,935 | A | 4/1963 | Brown | |
| 3,100,639 | A | 8/1963 | Bonewitz | |
| 3,134,591 | A | 5/1964 | Conn, Jr. et al. | |
| 3,188,087 | A | 6/1965 | Larson, Jr. | |
| 3,262,701 | A | 7/1966 | Howland | |
| 3,269,746 | A | 8/1966 | Jonker | |
| 3,279,794 | A | 10/1966 | Sherman | |
| 3,389,910 | A | 6/1968 | Kanzler, Jr. | |
| 3,419,267 | A | 12/1968 | Stolle | |
| 3,451,672 | A | 6/1969 | Kazdan | |
| 3,509,660 | A | 5/1970 | Seymour | |
| 3,512,774 | A | 5/1970 | Honer | |
| 3,522,953 | A | 8/1970 | Yevick et al. | |
| 3,525,522 | A | 8/1970 | Piller | |
| 3,586,321 | A | 6/1971 | Gehrke et al. | |
| 3,604,722 | A | 9/1971 | Boley | |
| 3,604,726 | A | 9/1971 | Tracy | |
| 3,612,520 | A | 10/1971 | Chang et al. | |
| 3,640,530 | A | 2/1972 | Henson et al. | |
| D223,113 | S | 3/1972 | King | |
| 3,649,007 | A | 3/1972 | Thomas | |
| 3,730,521 | A | 5/1973 | Sellman | |
| 3,749,399 | A | 7/1973 | Fedor et al. | |
| 3,761,084 | A | 9/1973 | Kieckmann | |
| 3,782,721 | A | 1/1974 | Passera | |
| 3,784,193 | A | 1/1974 | Simjian | |
| 3,803,757 | A * | 4/1974 | Sanchez | 446/242 |
| 3,806,116 | A | 4/1974 | Malmberg et al. | |
| 3,876,205 | A * | 4/1975 | Drohomirecky | 273/359 |
| 3,887,179 | A | 6/1975 | Klepper et al. | |
| 3,901,503 | A | 8/1975 | Klose | |
| 3,967,820 | A | 7/1976 | Harper | |
| D241,863 | S | 10/1976 | Friedl | |
| 3,984,100 | A | 10/1976 | Firster | |
| 3,988,931 | A | 11/1976 | Perryman | |
| 4,029,312 | A | 6/1977 | Wright | |
| 4,186,920 | A | 2/1980 | Fiore et al. | |
| 4,193,592 | A | 3/1980 | Bishow | |
| 4,199,137 | A | 4/1980 | Giguére | |
| 4,211,408 | A * | 7/1980 | Tickle | 446/325 |
| 4,279,415 | A | 7/1981 | Katz | |
| 4,290,601 | A | 9/1981 | Mittelstadt | |
| 4,480,831 | A | 11/1984 | Müller-Dienhardt | |
| 4,491,318 | A | 1/1985 | Francke | |
| 4,509,743 | A | 4/1985 | Lie | |
| 4,605,224 | A | 8/1986 | Tori | |
| 4,653,748 | A | 3/1987 | Seel et al. | |
| 4,801,140 | A | 1/1989 | Bergeron | |
| 5,496,248 | A | 3/1996 | Batscher | |
| 5,584,787 | A * | 12/1996 | Guidry | 482/146 |
| 5,647,830 | A | 7/1997 | Togao | |
| 5,683,284 | A * | 11/1997 | Christen | 446/233 |
| 5,810,703 | A * | 9/1998 | Stack | 482/146 |
| 5,897,474 | A | 4/1999 | Romero | |
| 6,017,297 | A | 1/2000 | Collins | |
| 6,019,712 | A | 2/2000 | Duncan | |
| 6,315,695 | B1 | 11/2001 | Follett et al. | |
| 6,413,197 | B1 | 7/2002 | McKechnie et al. | |
| 2002/0147087 | A1 * | 10/2002 | Tollner | 482/147 |

OTHER PUBLICATIONS

Radebold, Cholewicki, Polzhofer, Greene; Impaired Postural Control of the Lumbar Spine Is Associated With Delayed Muscle Response Times in Patients With Chronic Idiopathic Low Back Pain; Aug. 28, 2000; 7 pgs.

Radebold, Cholewicki, Panjabi, Patel; Muscle Response Pattern to Sudden Trunk Loading in Healthy Individuals and in Patients with Chronic Low Back Pain; Aug. 2, 1999; 8 pgs.

Wilder, Aleksiev, Magnusson, Pope, Spratt, Goel; Muscular Response to Sudden Load; May 13, 1966; 12 pgs.

Bullock-Saxton, Janda, Bullock; Reflex Activation of Gluteal Muscles in Walking; Jan. 23, 1992; 5 pgs.

Brandt, Krafczyk, Malsbenden; Postural Imbalance with Head Extension: Improvement by Training as a Model for Ataxia Therapy; 1981; 14 pgs.

Bohannon, Larkin, Cook, Gear, Singer; Decrease in Timed Balance Test Scores with Aging: Jul. 1984; 4 pgs.

Seidler, Martin; The effects of short term balance training on the postural control of older adults; 1997; 13 pgs.

Wolf, Barnhart, Kutner, McNeely, Coogler, Xu, Atlanta FICSIT Group; Reducing Frailty and Falls in Older Persons: An Investigation of Tai Chi and Computerized Balance Training; 1996; 9 pgs.

Wolfson, Whipple, Derby, Judge, King, Amerman, Schmidt, Smyers; Balance and Strength Training in Older Adults: Intervention Gains and Tai Chi Maintenance; 1996; 9 pgs.

Luoto, Aalto, Msci, Taimela, Hurri, Pyykko, Alaranta; One-Footed and Externally Disturbed Two-Footed Postural Control in Patients With Chronic Low Back Pain And Healthy Control Subjects; 1998; 10 pgs.

O'Connell, George, Stock; Postural sway and balance testing: a comparison of normal and anterior cruciate ligament deficient knees; 1998; 10 pgs.

Caraffa, Cerulli, Projetti, Aisa, Rizzo; Prevention of anterior cruciate ligament injuries in soccer; 1996; 2 pgs.

Ihara, Nakayama; Dynamic joint control training for knee ligament injuries; 1986; 7 pgs.

Wegener, Kisner, Nichols; Static and Dynamic Balance Responses in Persons with Bilateral Knee Osteoarthritis; 1997; 6 pgs.

Takala, Viikari-Juntura; Do Functional Tests Predict Low Back Pain?; 1999; 7 pgs.

Byl, Sinnott; Variations in Balance and Body Sway in Middle-Aged Adults; 1988; 6 pgs.

Mientjes, Frank; Balance in chronic low back pain patients compared to healthy people under various conditions in upright standing; 1999; 7 pgs.

Tropp, Askling, Gillquist; Prevention of ankle sprains; 1985; 4 pgs.

Rozzi, Lephart, Sterner, Kuligowski; Balance Training for Persons with Functionally Unstable Ankles; 1999; 9 pgs.

Gauffin, Tropp, Odenrick; Effect of Ankle Disk Training on Postural Control in Patients with Functional Instability of the Ankle Joint; 1988; 4 pgs.

Bernier, Perrin; Effect of Coordination Training on Proprioception of the Functionally Unstable Ankle; 1998; 12 pgs.

Freeman, Dean, Hanham; The Etiology and Prevention of Functional Instability of the Foot; 1965; 8 pgs.

Tropp, Ekstrand, Gillquist; Factors affecting stabilometry recordings of single limb stance; 1984; 4 pgs.

Tropp, Ekstrand, Gillquist; Stabilometry in functional instability of the ankle and its value in predicting injury; 1983; 3 pgs.

Balogun, Adesinasi, Marzouk; The Effect of a Wobble Board Exercise Training Program on Static Balance Performance and Strength of Lower Extremity Muscles; 1992; 8 pgs.

Waddington, Adams, Jones; Wobble board (ankle disc) training effects on the discrimination of inversion movements; 1999; 7 pgs.

OPTP, The Cutting Edge of Conservative Care; 2000; 6 pgs.

Thera Quip, Rehabilitation, Equipment and Supplies Catalog, 4 pgs.

Power Systems 2002 Catalog, 5 pgs.

* cited by examiner

EXERCISE DEVICE AND METHOD OF USING THE SAME

BACKGROUND OF INVENTION

So-called platform "wobble boards" and "rocker boards" are used to develop muscle strength, endurance, coordination and improve balance by training the nervous system and improving muscular responses to perturbed or unstable joint positions. The novice or unfit user may start using the device for range of motion control in a seated or non-weight bearing position. As the user becomes proficient in controlling the rocking motion of the platform in different planes (front/back, right/left oblique angles etc.), the attachment can achieve wobble movements in all directions (360°).

To have therapeutic effectiveness the device must have a degree of instability that provokes a quick muscle response. The device is intended to be useful for beginners all the way up to highly athletic individuals due to the inherent versatility of the device and the multiplicity of therapy variations. For instance the user may make the task more difficult or challenging by standing on one foot at a time and/or by closing the eyes.

The goal is to improve the neuromusculoskeletal response to labile surfaces which may provide a protective skill preventing future injuries. The somatosensory, vestibular, (inner ear) and visual systems of balance may be challenged in this manner. Standing on sufficiently unstable surfaces provokes strong muscle contractions. This produces a training effect for the feet/ankles, knees, hips, back, trunk, and head/neck regions as well as the upper extremities become engaged in the struggle to maintain balance, control body movements and posture. In short, the entire body may benefit from this movement therapy exercise device.

It has proven useful to increase the difficulty level as proficiency is obtained which has previously required multiple devices. Each device is often costly but required by the user if they desire to improve beyond certain introductory levels. Additionally, the devices are cumbersome to travel with such as taking them to an exercise facility or on vacation. The devices also require storage space in the user's home which is often at a premium.

SUMMARY OF INVENTION

The invention is directed to an exercise device that is adjustable for performing a variety of different exercises. In a first orientation with an attachment removed from a base, the device pivots along rails in a limited range of motion. In a second orientation with the attachment positioned within the base, the device pivots about the combined base and attachment in a larger range of motion.

In one embodiment, the device includes a platform, a base, and an attachment. The platform may have a variety of shapes and sizes depending upon the specific application. The base extends from one side of the platform and includes edges that define a recess. In a first orientation, the device pivots about the edges to perform exercises in a first orientation. An attachment is positionable within the recess. The attachment has a surface that compliments the surface of the base. In a second orientation, the device pivots about the attachment and the base in a range of motion that is greater than the first orientation.

Methods of using the device include removing the attachment from the recess and pivoting the device on the rails.

The attachment is then positioned within the recess and the device is pivoted in a greater range of motion than without the attachment.

DETAILED DESCRIPTION

Figure 1:
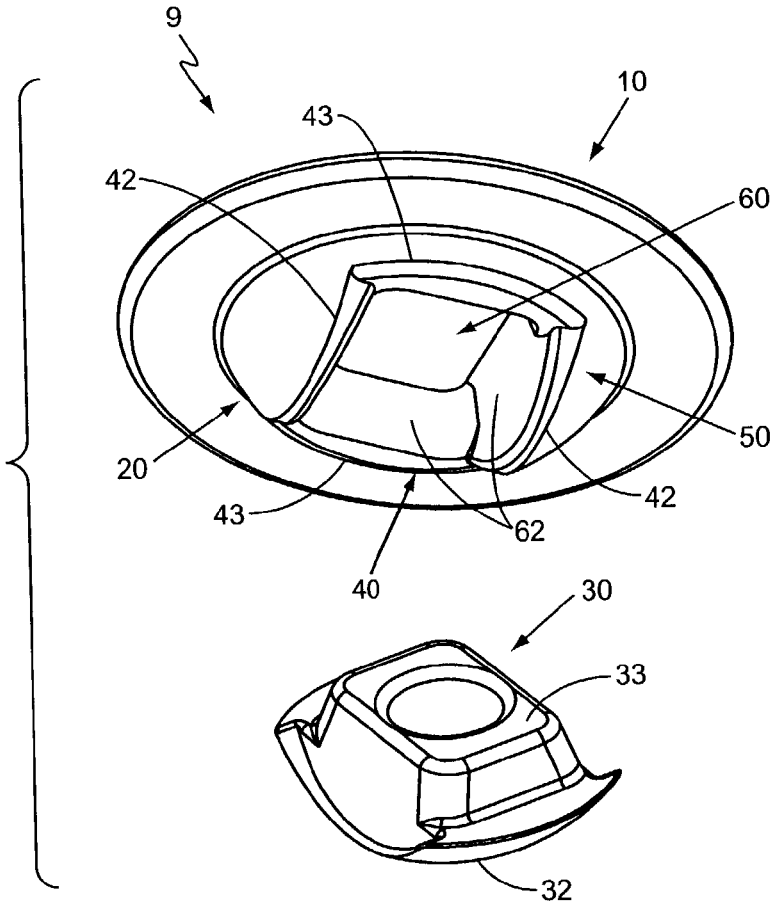
FIG. 1 is a perspective view of one embodiment of an exercise device of the present invention illustrating an attachment removed from the device.
Figure 2:
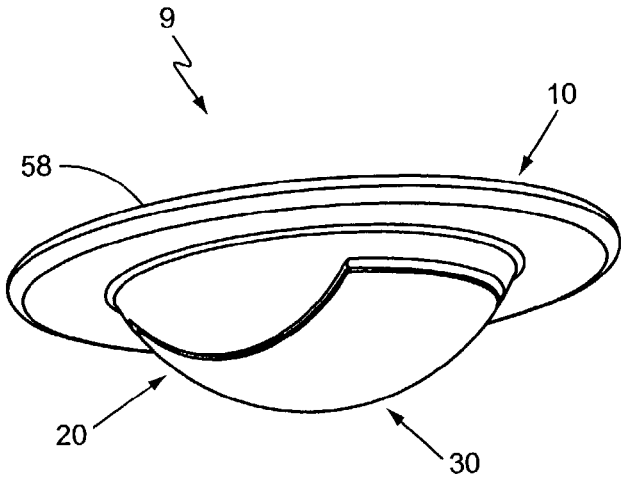
FIG. 2 is a perspective view of an exercise device of one embodiment of the present invention illustrating the attachment mounted to the device.

The present invention is an exercise device for conditioning and rehabilitation of the nerves, muscles, bones, and joints of the body by facilitating or limiting range of motion and biomechanical forces around the horizontal and vertical axes. As illustrated in FIG. 1, the device, generally illustrated 9, includes a fulcrum 20 connected to a first side of a platform 10. The fulcrum 20 extends outward from the platform 10 and provides a point about which the device 9 pivots. Fulcrum 20 includes a recess having a removable attachment 30. When the attachment 30 is connected as illustrated in FIG. 2, the exterior surface of the attachment 30 is complimentary to the exterior shape and surface of the fulcrum 20. A user positioned on the platform 10 can pivot about the fulcrum 20 in substantially 360° of motion. When the attachment 30 is removed, main edges 42 forming the recess 60 limit the pivoting motion between substantially a first direction and a second direction.

The term "pivot" and the like are used herein to describe the motion of the device 9. The device 9 can pivot in a larger range of motion with the attachment 30 included within the fulcrum 20. With the attachment 30, pivoting about the fulcrum 20 can include substantially 360° of motion. With the attachment 30 removed, device 9 pivots in a smaller range of motion between a first direction and a second direction. In one embodiment, a first direction and second direction are separated by about 180°. The beginner can utilize the device 9 without the attachment 30 to provide less degree of difficulty in operation. As the user progresses, the attachment 30 can be secured within, the recess 60 to provide a greater degree of difficulty. Likewise, the rehabilitation of a body part can be achieved by utilizing the device 9 without the attachment 30 and gradually increase intensity of the rehabilitation process by inserting the attachment 30 and increasing the range of motion.

Fulcrum 20 extends outward from the platform 10 and provides a structure about which the platform 10 pivots.

Fulcrum 20 includes a base 50 and a recess 60 within the base 50 to receive the attachment 30. With the attachment 30 connected, the exterior surface of the attachment 30 is complimentary to the exterior shape and surface of the fulcrum 20. In one embodiment, the fulcrum 20 is substantially semi-spherical in shape. The term "semi-spherical" means a geometric shape having a rounded surface for contacting a support. In one embodiment, the fulcrum 20 has a hemispherical shape, i.e., a one-half sphere. In one embodiment, fulcrum 20 has an elliptical shape with an elongated body extending between the platform 10 and rounded surface. In one embodiment, the fulcrum 20 comprises a plurality of shoulder formations allowing multiple forms of resistance to the user as described in U.S. Pat. No. 3,262,701 to Howland, which is incorporated herein by reference. Shoulder formations may have a variety of sizes and shapes to control the amount of resist when the user pivots the device 9.

Figure 3:
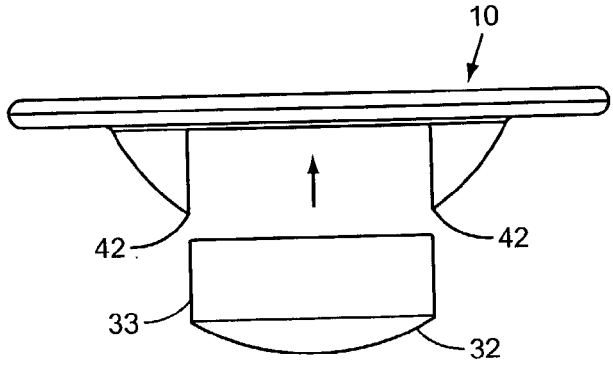
FIG. 3 is a cross sectional view of one embodiment of the exercise device with a recess and complimentary attachment.
Figure 4:
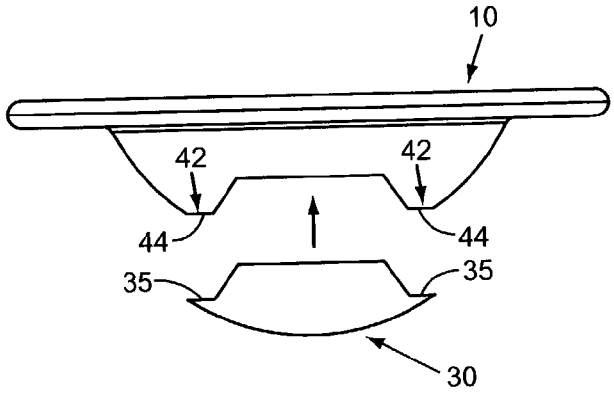
FIG. 4 is a cross sectional view of one embodiment of the exercise device with a recess and complimentary attachment.
Figure 5:
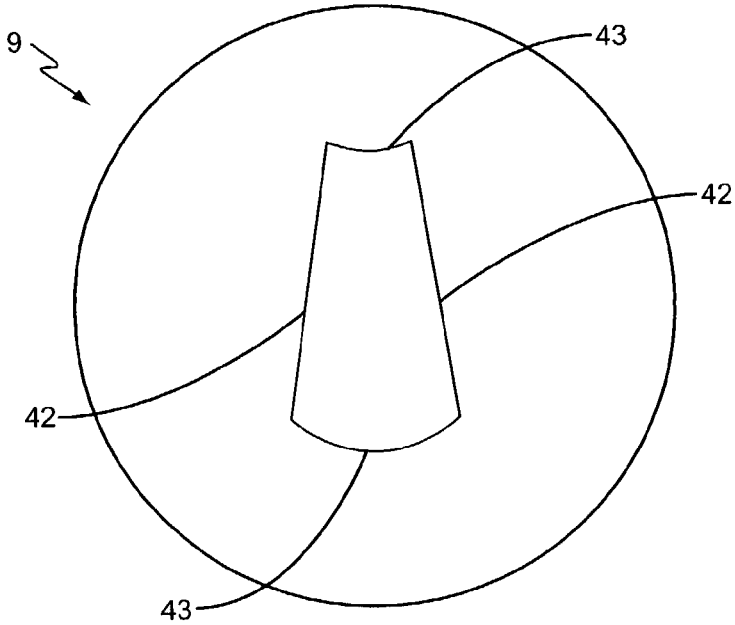
FIG. 5 is a plan view of the bottom of one embodiment of the exercise device according to the present invention.

Recess 60 may be positioned at a variety of locations within the base 50 to provide variability of motion. In the embodiment of FIG. 1, the recess 60 is centered within the base 50 with sections of the base 50 extending along each side between the platform 10 and recess 60. In one embodiment illustrated in FIG. 6, recess 60 is sized to extend substantially the entire span of the fulcrum 20, i.e., the base 50 is only on two sides and does not extend between the recess 60 and platform 10. In another embodiment as illustrated in FIG. 1, recess 60 is smaller and is surrounded by base 50 along each side. Recess 60 may have a variety of depths into the base 50. In one embodiment as illustrated in FIG. 3, recess 60 extends from the surface of the fulcrum 20 to a lower edge of the platform 10. In another embodiment illustrated in FIG. 4, recess 60 extends a distance less than the height of the base 50. In one embodiment, the base 50 of the fulcrum 20 comprises multiple recesses 60 to receive multiple attachments 30. Recess 60 may have a variety of shapes and sizes. In the embodiment illustrated in FIG. 1, recess 60 is substantially rectangular having four sides. In one embodiment as illustrated in FIG. 5, recess 60 has a more triangular shape.

Base 50 includes edges 40 that define the recess 60. Edges 40 may have a variety of shapes and lengths depending upon the specific embodiment. Edges 40 may intersect with the surface of the fulcrum 20 to form a tip as illustrated in FIG. 3, or may have more rounded shapes. One skilled in the art will understand that various embodiments are possible and are included within the scope of the present invention.

One embodiment of the edges 40 includes two main edges 42 that contact the surface and support the device 9 when the attachment 30 is removed. Main edges 42 control the direction of travel as the device 9 pivots between the first and second directions. Secondary edges 43 also form a part of the recess 60. The main edges are positioned from the platform 10 a greater amount than secondary edges 43 to contact the support surface when the attachment 30 is removed. In the embodiment of FIG. 1, main edges 42 are located parallel to each other and provide equal resistance when user pivots between first and second directions. In another embodiment as illustrated in FIG. 5, main edges 42 are oblique providing more resistance when the user moves the base 10 in the direction of the converging end and less resistance in the direction of the diverging end. In one embodiment, edges 42 are elliptical.

Main edges 42 may have a variety of shapes and sizes. In one embodiment illustrated in FIG. 3, main edges 42 include a pointed edge on which the device 9 is supported when the attachment 30 is removed. In another embodiment as illustrated in FIG. 4, main edges 42 include a flat rail 44. Flat rail 44 contacts the support when the attachment 30 is removed from the recess 60 providing guidance between the first and second directions.

Attachment 30 fits within the recess 60 providing an exterior surface complimentary to the exterior shape and surface of the fulcrum 20. In one embodiment as illustrated in FIG. 1, attachment 30 comprises a rounded surface 32 and a body 33 that extends into the recess 60. In one embodiment, a rounded surface 32 abuts against the surface of the base 50 giving the fulcrum 20 a smooth, continuous surface. Body 33 may have a variety of different orientations to mate within the recess 60. One embodiment illustrated in FIG. 3 includes substantially straight walls. The embodiment of FIG. 4 includes angled walls with wings 35 that conform to the dimensions of the recess 60.

Figure 6:
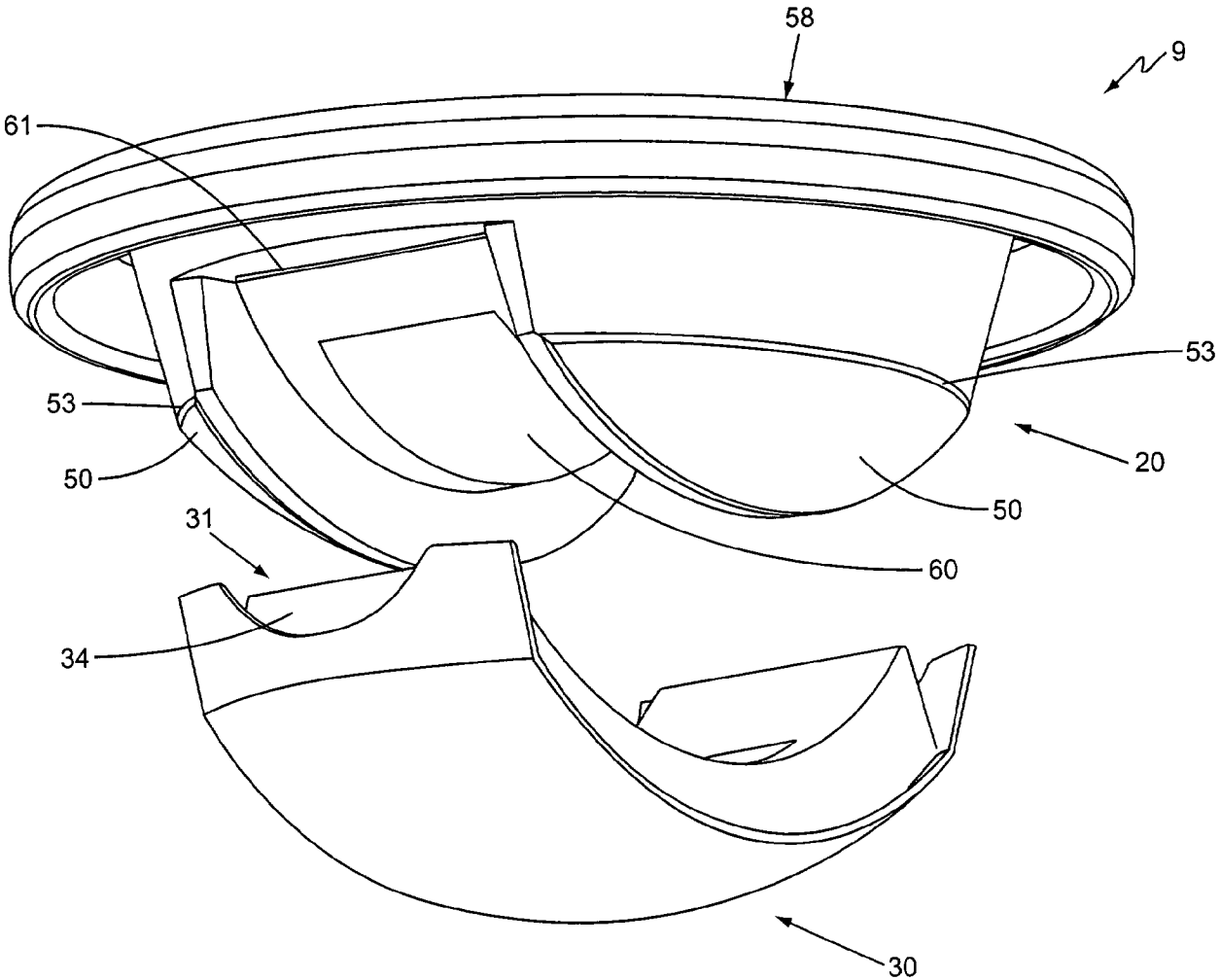
FIG. 6 is a perspective view of an exercise device of one embodiment of the present invention illustrating the attachment with a locking mechanism for mounting to the device.
Figure 7:
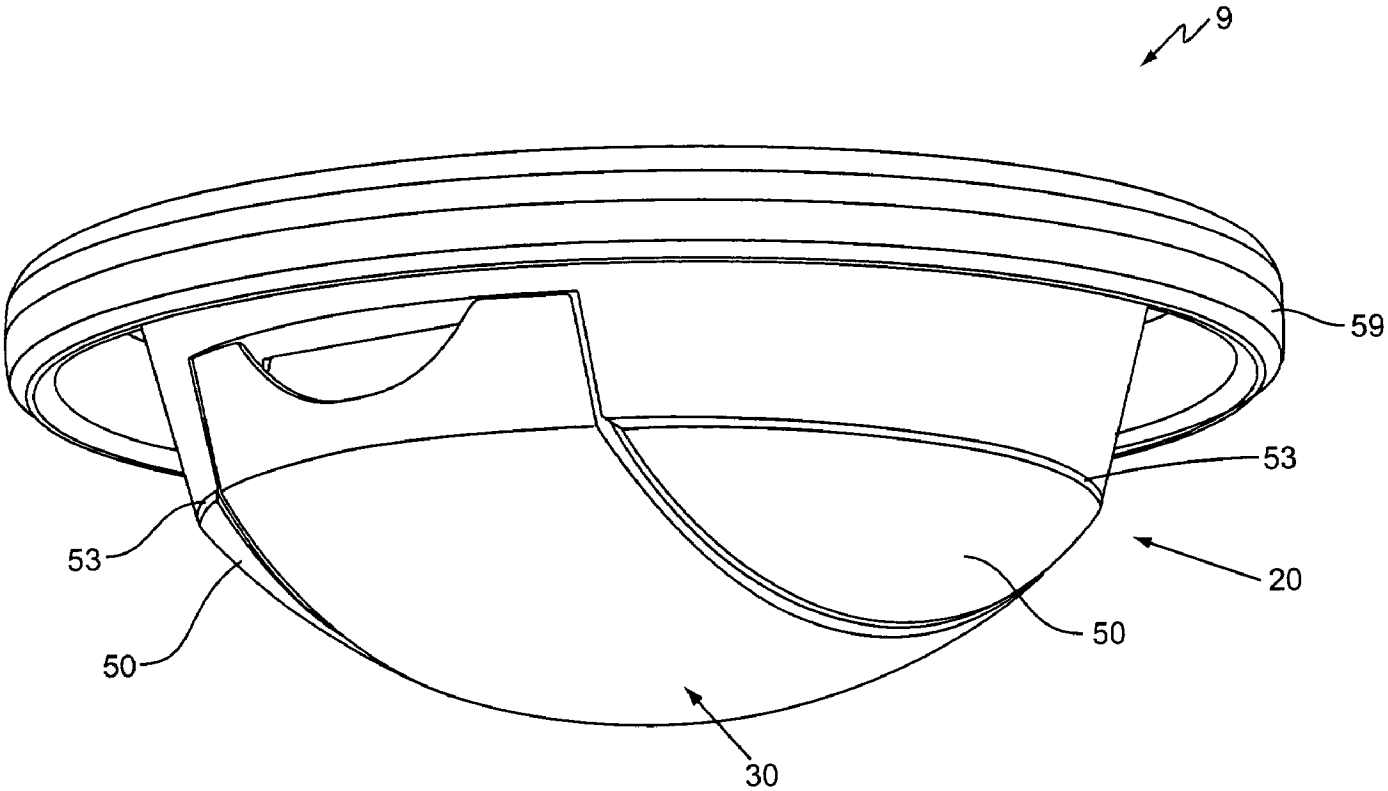
FIG. 7 is a perspective view of an exercise device of one embodiment of the present invention illustrating the attachment secured to the device.

FIGS. 6 and 7 illustrate another embodiment of the present invention comprising a shoulder 53 located on the fulcrum 20. In one embodiment, shoulder 53 extends around both the attachment 30 and the base 50. Shoulder 53 may be substantially perpendicular to the surface of the fulcrum 20, or can extend in a variety of different angles. Shoulder 53 extends outward from the fulcrum 20 to limit the range of motion when pivoting. Device 9 can be pivoted an amount until the shoulder 53 contacts the surface to stop the pivot motion. In one embodiment, shoulder 53 is continuous and spans the entire length of the fulcrum 20. In another embodiment, shoulder 53 extends around less than the entire diameter of the fulcrum 20.

A locking mechanism 31 is positioned on the fulcrum 20 to secure the attachment 30 within the recess 60. In one embodiment, locking mechanism 31 comprises a lip 34 on the attachment 30 that is positionable between a locked and unlocked orientation. Lip 34 is forced beyond a channel recess 61 in the recess 60 to lock the attachment 30 into the recess 60. In one embodiment, locking mechanism 31 is recessed from the surface of the fulcrum 20 to prevent interference of the pivoting movement. The locking mechanism 31 is accessible from outside the device 9 by forcing the lip 34 away from the channel recess 61 thus removing the attachment 30 from the fulcrum 20. In another embodiment, locking mechanism 31 comprises a hook or dowel on the attachment 30 and a hole on the recess 60. The hook or dowel is positioned within the hole to secure the attachment 30. In another embodiment, locking mechanism 31 comprises a fastener that is threaded to secure the attachment 30 within a threaded hole in the recess 60. In another embodiment, locking mechanism 31 comprises clips for securing attachment 30 within the fulcrum 20. One skilled in the art will understand that various embodiments of a locking mechanism 31 are possible and are included within the scope of the present invention.

Figure 8:
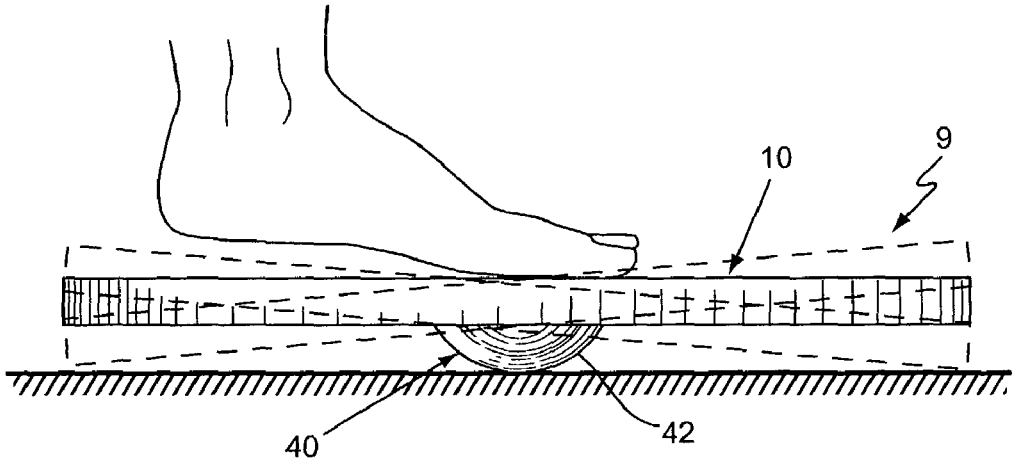
FIG. 8 is a, side view illustrating one embodiment of a user's foot positioned on the device.

Platform 10 provides a surface on which the user positions part or all of the body. Platform 10 may have a variety of shapes and sizes depending on the desired pivoting motion. In one embodiment, platform 10 extends outward beyond the fulcrum 20 to contact the support surface as the device 9 pivots to control the degree of pivot. In another embodiment, platform 10 is sized substantially equal to the size of the fulcrum 20 to which it is attached. In the embodiment of FIG. 8, a brim 59 is positioned around the outer edge of the platform 10 and extends between the platform 10 and a support surface to limit range of motion for the user. In another embodiment, the brim 59 is adjustable with respect to a distance between the platform 10 and a support surface to allow different ranges of pivoting motion. In another embodiment, brim 59 extends to the bottom of the platform 10 to provide a larger range of motion. Brim 59 may have a variety of sizes and shapes. In one embodiment, brim 59 extends around the entire outer edge of the platform 10. In another embodiment, brim 59 extends around only a portion of the outer edge.

A top surface 58 of the platform may have a roughened surface to facilitate the user positioning their body on the platform 10. A cushioned surface may be positioned on the top surface 58 to cushion the user and further prevent slipping from the platform 10. In one embodiment, top surface 58 comprises fasteners for removable foot arch support shapes for user to stand on and pivot device 9. In one embodiment as illustrated in FIG. 1, the platform 10 is substantially flat. In another embodiment, the platform 10 may have an uneven surface to assist in balancing the user and preventing slippage. Platform 10 can comprise many shapes including substantially circular, elliptical, rectangular, or shaped to conform to a body part. In one embodiment, platform 10 is separable from the base 50 of the fulcrum 20 to allow other platforms to be fitted with the fulcrum 20. Platform 10 can contain pegs that mate with holes in the base 50 of the fulcrum 20 to attach platform 10 to fulcrum 20. One skilled in the art will understand that various embodiments of attaching platform to fulcrum are possible and are included within the scope of the present invention.

In one embodiment, fulcrum 20 is centered on the platform 10 as illustrated in FIG. 1. In another embodiment, fulcrum 20 is off-center on the platform 10. Fulcrum 20 may have a range of different diameters and heights. In one embodiment, fulcrum 20 has a semi-spherical shape. However, fulcrum 20 can comprise different shapes to facilitate diverse ranges of motion. In one embodiment, fulcrum 20 comprises a plurality of shoulder formations allowing multiple forms of resistance to the user.

Device 9 may be constructed in a variety of manners. In one embodiment, device 9 is constructed by molding, including blow molding, pressure molding, rotational molding, and injection molding. In another embodiment, device 9 is cut from wood by lathing. In another embodiment, device 9 is cast or forged from metals or other solids. Device 9 interior structure may be hollow with support structures, i.e., struts, braces. In the embodiment of FIG. 1, recess 60 comprises interior walls 62 that extend between the platform 10 and the interior wall of the base 50 to strengthen the device 9. In another embodiment, supports extend throughout the interior of the device 9 for increased strength. In one embodiment, device 9 is solid. One skilled in the art will understand that various embodiments of constructing device are possible and are included within the scope of the present invention.

One manner of using the device is illustrated in FIG. 8. In this embodiment, the user positions the device 9 on a support surface in a manner to allow the user to apply force to platform 10 with one or both feet and pivot the platform 10 along the main edges 42 of the fulcrum 20. With the attachment 30 removed, the main edges 42 engage the support surface and provide guidance as the user applies force with their foot in a first direction and then with the heel of the foot-in a second direction. The range of motion is limited to forward and reverse directions along the main edges 42 to reduce a risk of injury to a new user of the device 9, or an injury that is not yet ready for additional motion. With the attachment 30 still removed, the user can then turn the device 9 to allow flexing of the ankle from side to side along the main edges 42. The degree of pivoting is limited by the platform 10 contacting the support surface as illustrated by the dashed lines of FIG. 8.

As the training increases or the rehabilitation progresses, the user may increase the range of motion by inserting the attachment 30 and pivoting the device 9 in substantially 360° of motion. The user can apply force to the platform 10 and pivot the device 9 to flex and stretch the foot and ankle. In one embodiment, the user can then pivot the device 9 to the shoulder 53 where the user will encounter resistance, limiting the range of pivoting. In another embodiment, the device 9 can be pivoted to contact the platform 10 to the support surface providing a greater range of motion for the device 9.

User may position other body parts on device 9 for rehabilitation or exercise purposes, such as sitting on device 9 and pivoting for posture training or placing arms and hands on device 9 for strength and flexibility training.

Device 9 may comprise flexible material within the platform 10 and/or fulcrum 20 to allow motion along varying heights of the platform 10 with respect to a support surface, such as springs or expandable rubber. The device 9 pivots about a support surface, such as a floor within the user's home, workplace, gym, and the like. In one embodiment, the support surface is flat. One skilled in the art will understand that the device 9 can be used on a variety of different supports surfaces, which are to be included within the scope of the present invention.

The present invention may be carried out in other specific ways than those herein set forth without departing from the scope and essential characteristics of the invention. The device may be constructed of a variety of suitable, rigid materials, such as wood, plastic or metal. In one embodiment, the device pivots in the second orientation on both the attachment and base. In another embodiment, the device pivots in the second orientation only about the attachment. The present embodiments are, therefore, to be considered in all respects as illustrative and not restrictive, and all changes coming within the meaning and equivalency range of the appended claims are intended to be embraced therein.

What is claimed is:

1. An exercise device comprising:

a platform;

a fulcrum extending outward from the platform comprising a base with edges that define a recess, the edges defining at least two points of contact; and an attachment shaped to fit within the recess and having a rounded exterior surface complimentary to a semi-spherical exterior surface of the fulcrum;

in a first orientation the attachment is removed from the recess and the device pivots on an underlying support surface about the edges of the base on the at least two points of contact and in a second orientation the attachment is positioned within the recess and the device pivots on the underlying support surface about a single point of contact formed by the rounded exterior surface of the attachment.

2. The device of claim 1, wherein the device further comprises a shoulder extending outward from the base and the attachment, the attachment being positioned within the recess such that the shoulder on the attachment aligns with the shoulder on the base.

3. The device of claim 1, wherein the recess is substantially rectangular in shape.

4. The device of claim 1, wherein the recess is substantially triangular in shape.

5. The device of claim 1, wherein the recess comprises straight interior walls with the edges that define the recess being pointed.

6. The device of claim 1, wherein the edges are substantially flat.

7. The device of claim 6, wherein the attachment comprises wings that mate with the edges when the attachment is positioned within the recess in the second orientation.

8. The device of claim 1, further comprising a locking mechanism for locking the attachment within the recess in the second orientation.

9. The device of claim 1, wherein the recess comprises main edges and secondary edges with the main edges contacting a support surface in the first orientation as the device pivots.

10. The device of claim 8, wherein the main edges are parallel.

11. The device of claim 9, wherein the main edges are oblique.

12. An exercise device comprising:

a platform;

a fulcrum attached to the platform, the fulcrum having a pair of rails separated by a recess with the rails extending below the platform;

an attachment sized to be positioned within the recess and extend beyond the rails;

the fulcrum being adjustable between a first orientation with the attachment removed from the recess and the rails contacting a support surface to provide at least two points of contact for movement to the base between a first and second direction approximately 180 degrees apart, and a second orientation having the attachment positioned within the recess with the attachment contacting the support surface to provide one point of contact for movement in substantially 360 degrees.

13. The device of claim 12, wherein the pair of rails are parallel.

14. The device of claim 12, wherein the rails have a pointed orientation.

15. The device of claim 12, wherein the rails have a flat orientation.

16. A method of using an exercise device on a supporting surface, the method comprising the steps of:

pivoting the device in a first range of motion of about 360 degrees with a fulcrum and an attachment contacting the supporting surface;

removing the attachment from the fulcrum member; and pivoting the device about rails that contact the supporting surface in a second range of motion that is less than the first range of motion.

17. The method of claim 16, wherein pivoting the device in the second range of motion comprises pivoting between a first direction and a second direction that are about 180 degrees apart.

18. The method of claim 16, further comprising limiting the range of motion by contacting a platform that supports the user against the supporting surface.

19. The method of claim 16, further comprising compressing the device towards the support surface when pivoting the device.

20. The method of claim 16, further comprising locking that attachment within the fulcrum member.

* * * * *